US009130312B2

(12) United States Patent
Wu et al.

(10) Patent No.: US 9,130,312 B2
(45) Date of Patent: Sep. 8, 2015

(54) CABLE CONNECTOR ASSEMBLY

(71) Applicant: HON HAI PRECISION INDUSTRY CO., LTD., New Taipei (TW)

(72) Inventors: Jerry Wu, Irvine, CA (US); Chien-Chiung Wang, New Taipei (TW); Jun Chen, Kunshan (CN); Fan-Bo Meng, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 145 days.

(21) Appl. No.: 13/937,184

(22) Filed: Jul. 8, 2013

(65) Prior Publication Data

US 2014/0011385 A1 Jan. 9, 2014

(30) Foreign Application Priority Data

Jul. 6, 2012 (CN) ..... 2012 1 0233000

(51) Int. Cl.

| | |
|---|---|
| ***H01R 9/03*** | (2006.01) |
| ***H01R 13/646*** | (2011.01) |
| ***H01R 13/6474*** | (2011.01) |

(52) U.S. Cl.

CPC ..... *H01R 13/646* (2013.01); *H01R 13/6474* (2013.01); *H01R 9/034* (2013.01)

(58) Field of Classification Search

CPC ... H01R 13/646; H01R 13/6474; H01R 9/034
USPC ..... 439/626, 108, 660, 607.1, 607.41, 939
See application file for complete search history.

(56) References Cited

U.S. PATENT DOCUMENTS

| | | | | |
|---|---|---|---|---|
| 7,422,488 | B1 | 9/2008 | Wu | |
| 7,467,973 | B2 * | 12/2008 | Lee et al. | 439/582 |
| 7,618,293 | B2 * | 11/2009 | Wu | 439/660 |
| 8,262,296 | B2 * | 9/2012 | Liao et al. | 385/90 |

* cited by examiner

*Primary Examiner* — Javaid Nasri
(74) *Attorney, Agent, or Firm* — Wei Te Chung; Ming Chieh Chang

(57) ABSTRACT

A cable connector assembly comprises a housing; a plurality of first contacts received in the housing; and cable having at least a first set of cable electrically respectively connected to the corresponding first contacts. Each of the first set of cable comprises a plurality of first wires formed therein. At least one of the first wires of one first set of cable is cut out, and the rest of the first wires of one first set of cable are electrically connected with the corresponding first contact.

8 Claims, 7 Drawing Sheets

CABLE CONNECTOR ASSEMBLY

BACKGROUND OF THE INVENTION

1. Field of the Invention

The present invention relates to a cable connector assembly, and more particularly to a cable connector assembly for transmitting high speed signal.

2. Description of Related Art

At present, in commonly used cable connector assembly, due to its structure, impedance of the cable connector assembly will affect the quality of the signal transmission. Thus, it is necessary to overcome or reduce the effect to the signal transmission by the impedance.

In prior art, a cable connector assembly comprises a housing, a number of contacts received in the housing and a cable with a number of wires. Each of contact comprises a mating portion mating with a complementary connector, a soldering portion soldered with the wires and a connecting portion connecting the mating portion and the soldering portion. And, a thickness of the mating portion, the connecting portion and the soldering portion are roughly the same. When a wire is soldered with the soldering portion, a thickness (A) of a conductor for transmitting signal between the contact and the wire is formed by a thickness of the soldering portion, a diameter of the wire and a thickness of the solder. When the cable connector assembly is mating with a complementary connector, a thickness (B) of the conductor for transmitting signal between the cable connector assembly and the complementary connector is the sum of the mating portions of the two contacts. At this time, whether A or B is greater than the thickness of the connecting portion. As a result, in the process of signal transmission, the thickness of the conductor for transmitting signal changes suddenly. And, the dielectric constant, the diameter of the wire, the thickness of the contact and others affecting the impedance data will not make an effective compensation. In the process of data transmission, the evident impedance mutation of the cable connector assembly effects the transmission quality.

Hence, an improved cable connector assembly is desired to overcome the above problems.

BRIEF SUMMARY OF THE INVENTION

A primary object, therefore, of the present invention is to provide a cable connector assembly with improved performance of signal transmission thereof According to one aspect of the present invention, a cable connector assembly comprises a housing; a plurality of first contacts received in the housing; and a cable having at least a first set of cable electrically respectively connected to the corresponding first contacts. Each of the first set of cable comprises a plurality of first wires formed therein. At least one of the first wires of one first set of cable is cut out and the rest of the first wires of one first set of cable are electrically connected with the corresponding first contact.

According to another aspect of the present invention, a cable connector assembly comprises a housing; a plurality of first contacts received in the housing ; and a plurality of first set of cables electrically connected with corresponding first contacts. Each of first set of cable comprises a plurality of first wires and an insulative jacket surrounding the plurality of first wires, at least seven first wires of the plurality of first wires are electrically connected to a first contact, the rest of first wires of the plurality of first wires are cut out.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
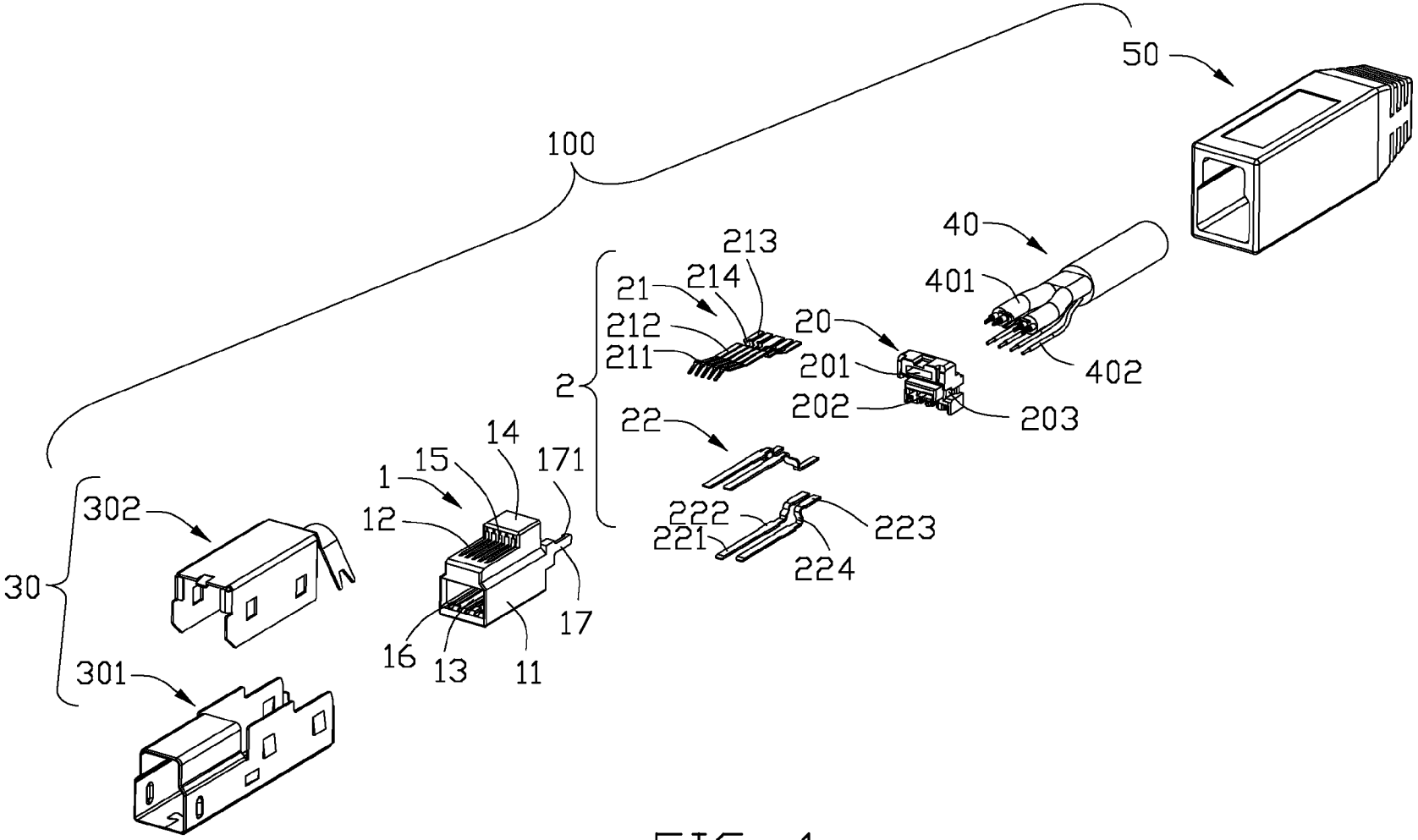
FIG. 1 is a exploded view of a cable connector assembly according to the present invention.
Figure 2:
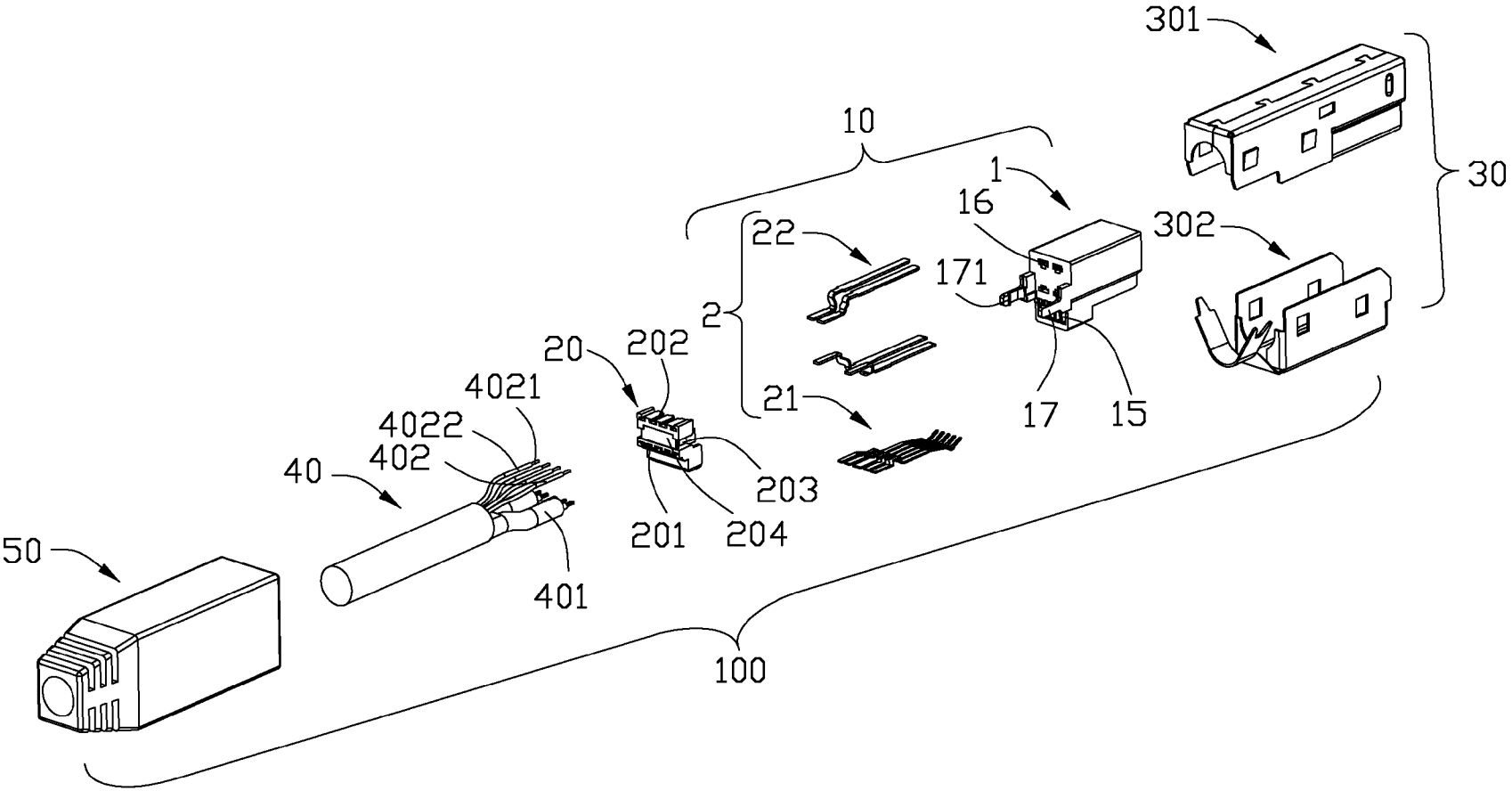
FIG. 2 is similar to FIG. 1, but viewed from another direction.
Figure 3:
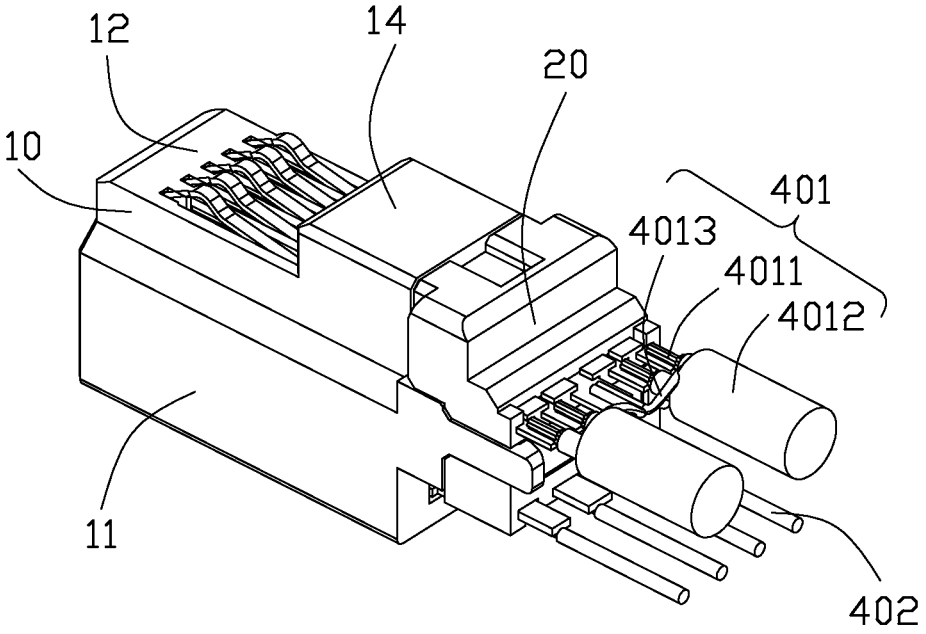
FIG. 3 is a partial perspective view of the cable connector assembly showing in FIG. 2.
Figure 4:
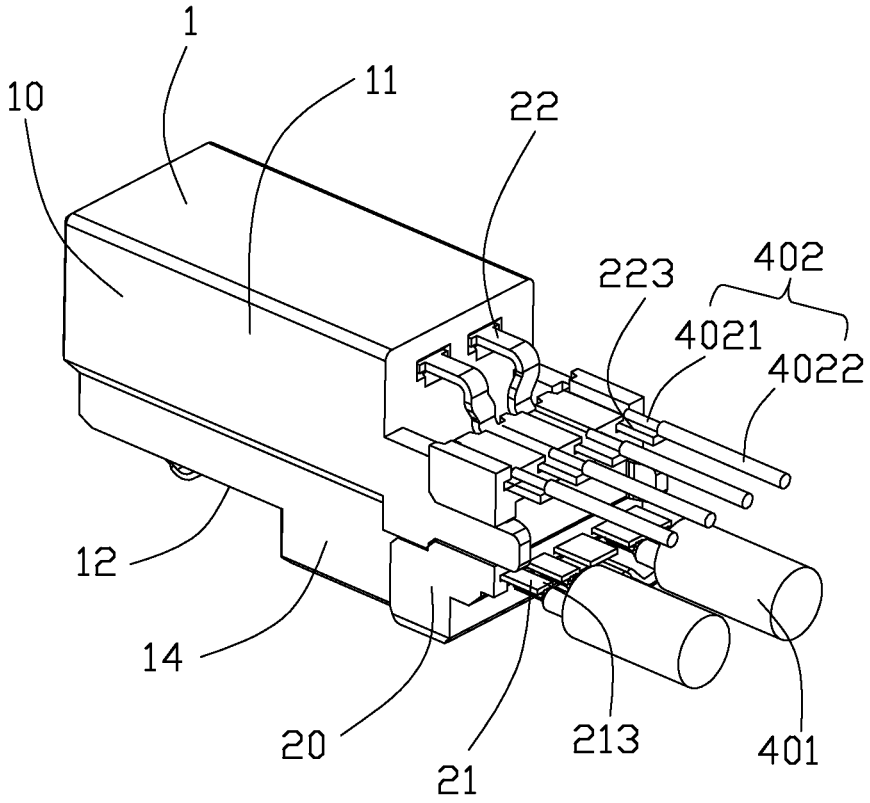
FIG. 4 is similar to FIG. 3, but viewed from other direction.
Figure 5:
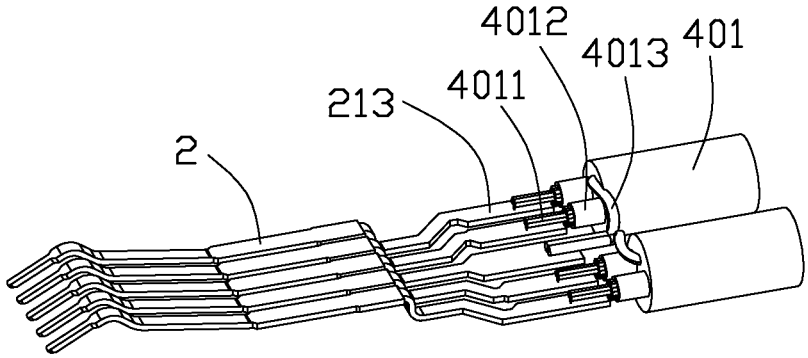
FIG. 5 a partial perspective view of the cable connector assembly showing the first contacts connected with the first set of the cables.
Figure 6:
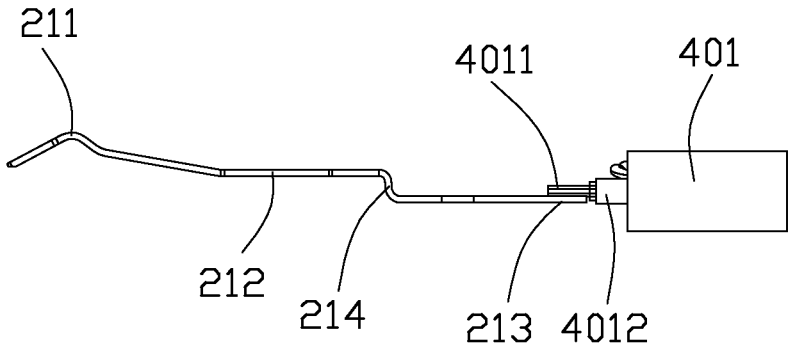
FIG. 6 is similar to FIG. 5, but viewed from side.
Figure 7:
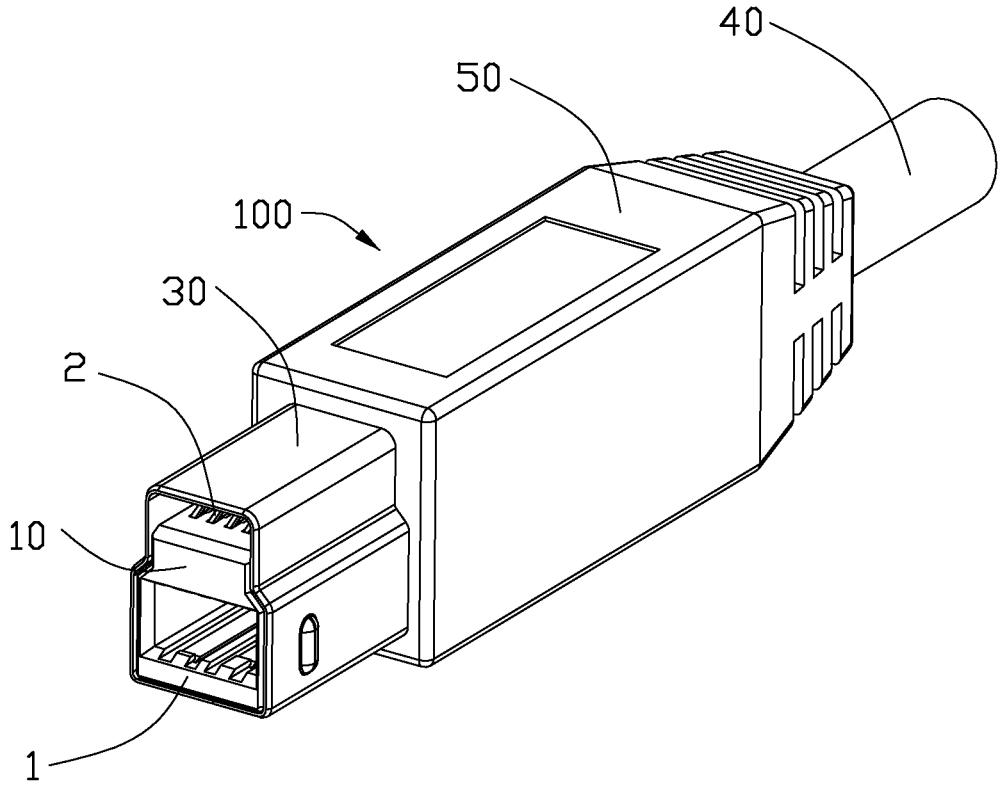
FIG. 7 is a perspective view of the cable connector assembly.

Referring to FIGS. 1-7, a cable connector assembly 100 comprises a connector 10, a spacer 20 assembled to a rear end of the connector 10, a shell 30 enclosing the connector 10, a cable 40 connected with the connector 10 and a cover 50 enclosing the shell 30.

Referring to FIGS. 1-4, the connector 10 comprises a housing 1 and a plurality of contacts 2 received in the housing 1.

The housing 1 includes a main portion 11, a recess 12 recessing downwardly from an upper surface of the main portion 11, a chamber 13 recessing rearwardly from a front surface of the main portion 11 and a plate 14 located at the back of the recess 12. A plurality of first passageways 15 penetrating the plate 14, communicating with the recess 12 and extending to a lower surface of the recess 12 and a plurality of second passageways 16 penetrating a rear surface of the main portion 11, communicating with the chamber 13 and exposing on the upper and lower surface of the chamber 13. The housing 1 further comprises a pair of extending portions 17 extending rearwardly from the main portion 11. A pair of hooks 171 are respectively formed at two rear ends of the extending portions 17 and arranged face to face.

The contacts 2 comprises a plurality of first contacts 21 and a plurality of second contacts 22. Each of first contact 21 comprises a first retaining portion 212, a first mating portion 211 extending forwardly from the first retaining portion 212, a first soldering portion 213 at the rear of the first contacts 21 and a first connecting portion 214 located between the first retaining portion 212 and the first soldering portion 213. The mating portion 211 is winding. The first contacts 21 are arranged in a row. Each of second contact 22 comprises a second retaining portion 222, a second mating portion 221 extending forwardly from the second retaining portion 222, a second soldering portion 223 at the rear of the second contacts 22 and a second connecting portion 224 located between the second retaining portion 222 and the second soldering portion 223. The second mating portion 221 is structured in a flat shape. Both the second mating portion 221 and the second retaining portion 222 are arranged in two rows. The two rows of second connecting portion 224 are bent and extending at opposite direction each other to make sure the second soldering portion 223 be arranged in the same row.

The spacer 20 includes a plurality of first slots 201 and a plurality of second slots 202 penetrating the front and rear surfaces of the spacer 20. The second slots 202 expose on the lower surface of the spacer 20. The spacer 20 further comprises two grooves 203 extending inwardly from the two lateral surface of the spacer 20. The grooves 203 and the extending portion 17 of the housing 1 together fix the spacer 20. The spacer 20 further comprises a slit 204 recessing forwardly from the rear surface of the spacer 20 and located between the first slots 201 and the second slots 202.

The metal shell 30 includes a front shell 301 received in the housing 1 and a rear shell 302 assembled with each other.

The cable 40 comprises two first sets of cable 401 soldered with the first contacts 21 and four second sets of the cable 402 soldered with the second contacts 22. Each of first set of cable 401 comprises a plurality of first wires 4011 arranged into two groups and respectively surrounded by two insulative outer jackets 4012. A number of one group of first wires 4011 is equal to the number N(N≥2). And a number of one group of the first wires 4011 soldered to the contact and exposed out of the insulative outer jackets 4012 is at least reach to N−1. This is to say, a part of the first wires 4011 exposed out of the insulative outer jackets 4012 are cut out and arranged around the rest first wires 4011 which are not cut out. Each of first set of the cable 401 further comprise a grounding wire 4013. Each of second set of the cable 402 comprises a second wires 4021 and an insulative outer jackets 4022 enclosing the second wires 4021.

In this case, one group of the first wires 4011 are structured in 24 AWG diameter and comprises 19 first wires 4011. Each of first wire 4011 has a diameter of 0.127 mm. When 17 first wires 4011 are cut out, thus, a diameter of the rest of 7 first wires 4011 (seven is the minimum number of the American wire gauge) is reached to a diameter of 28 AWG. Another group of first wires 4011 are structured in 24 AWG diameter and comprises 28 first wires 4011. A diameter of each of first wire is reached to 0.100 mm. When 21 first wires are cut out, thus, a diameter of the rest of 7 (The minimum is 7 according to the American wire gauge) is reached to the standard 30 AWG. According to need, of course, the number of the remaining first wires can be set to more than 7 after cutting out part of the first wires 4011. An arbitrary diameter of the first wires 4011 soldered to the first contacts 21 can be achieved through above said method.

When assembling the cable connector assembly 100, a plurality of first contacts 21 are respectively received in the first passageways 15 with the surface of the mating portion 211 exposing on the surface of the recess 12 and the retaining portion 212 retained under the plate 14, a plurality of second contacts 22 are received in second passageways 16 with the second mating portion 221 are respectively located on the top and lower surface of the chamber 13, the second soldering portion 223 arranged in a row and the retaining portion 222 retained in the main portion 11. In order to assemble the spacer 20, the grooves 203 of the spacer 20 are received in the extending portion 17 and the hooks 171 are assembled in the slits 204. The first soldering portion 213 are received in the first slots 201 and exposed on the surface or the rear of the first slots 201, and the soldering portion 223 are arranged in a row, received in the second slots 202 and exposed on the surface or the rear of the second slots 202. The conductors of the second wires 4021 respectively are soldered with the second soldering portion 223. The retaining conductors of the cut wires are soldered with the first soldering portions 213. The grounding wire 4013 are soldered with one of the first contacts 21. In this case, the method of connecting the contacts and the wires can be replaced by riveting rather other soldering.

The connector 10 and the spacer 20 are received in the front shell 301. The three surfaces of the front shell 301 and the recess 12 surround a cavity (not labeled), the back shell 302 is assembled at the back of the front shell 301. The front and back shell 301,302 together enclose the spacer 20. The cover 50 formed on the surface of the shell 30 and the cable 40 protects them from damage.

Because of cutting part of the conductors at the front of the first wires 4011 and reducing the diameter of the first wires 4011, the thickness of the soldering section of the first wires 4011 and the first contacts 21 is smaller than the existing technology (the diameter of the uncut first wires 4011) and the height of the soldering section and the first contacts 21 is smaller. In the process of the data and signal transmission, the impedance mutation phenomenon is significantly diminished and the quality of data and signal transmission is improved.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable connector assembly comprising:

an insulative housing;

a plurality of contacts disposed in the housing, each of said contacts defining a front contacting section and a rear connecting section; and a cable including a plurality of sub-cables, each of said sub-cables including an inner conductor enclosed in an outer jacket, the inner conductor being formed by plural bundles of tiny conductive wires; wherein in the inner conductor of each of said sub-cables, front end portions of some corresponding bundles are removed to form a diametrically reduced dimension of an exposed front end section of the inner conductor, compared with remainders of said inner conductor along said sub-cable, for being soldered unto the connecting section of the corresponding contact for optimizing impedance control along the corresponding contact.

2. The cable connector assembly as claimed in claim 1, wherein said bundles are essentially arranged concentrically, and said some bundles are located around a peripheral area.

3. The cable connector assembly as claimed in claim 1, wherein an amount of said some bundles is not less than one half of a sum of said bundles.

4. The cable connector assembly as claimed in claim 1, wherein a thickness of each of said contacts keeps constant from the front contacting section to the rear connecting section.

5. The cable connector assembly as claimed in claim 1, wherein each of said contacts defines a rear edge on the rear connecting section, and said some bundles of the corresponding inner conductor are terminated behind said rear edge.

6. A cable connector assembly comprising:

an insulative housing;

a plurality of contacts disposed in the housing, each of said contacts defining a front contacting section and a rear connecting section; and a cable including a plurality of sub-cables, each of said sub-cables including an inner conductor enclosed in an outer jacket; wherein in each of said sub-cables, a front end section of the inner conductor has a diametrically reduced dimension, compared with remainders of said inner conductor along said sub-cable, so as to have the exposed front end section of the inner conductor soldered unto the connecting section of the corresponding contact for optimizing impedance control along the corresponding contact.

7. The cable connector assembly as claimed in claim 6, wherein the front end section of the inner conductor is concentric with regard to the whole inner conductor in a cross-sectional view.

8. The cable connector assembly as claimed in claim 7, wherein said inner conductor is composed of a plurality of tiny wires in a bundle manner and some tiny wires are removed at the front end section of the inner conductor.

* * * * *